US006700102B2

(12) United States Patent
St. Louis

(10) Patent No.: US 6,700,102 B2
(45) Date of Patent: Mar. 2, 2004

(54) DRYER CONTROL CIRCUIT

(75) Inventor: Robert Maurice St. Louis, Boucherville (CA)

(73) Assignee: Camco Inc., Mississauga (CA)

( * ) Notice: Subject to any disclaimer, the term of this patent is extended or adjusted under 35 U.S.C. 154(b) by 0 days.

(21) Appl. No.: 10/277,939

(22) Filed: Oct. 23, 2002

(65) Prior Publication Data

US 2003/0097764 A1 May 29, 2003

(30) Foreign Application Priority Data

Nov. 29, 2001 (CA) ..... 2364219

(51) Int. Cl.[7] ..... H05B 1/02

(52) U.S. Cl. ..... 219/511; 219/481; 219/494; 34/526; 34/524; 34/549; 236/46 R

(58) Field of Search ..... 219/494, 491, 219/511, 501, 497, 483, 486, 481, 510; 34/269, 524, 549, 553, 526; 236/46 R, 40; 318/781

(56) References Cited

U.S. PATENT DOCUMENTS

| | | | | |
|---|---|---|---|---|
| 2,878,580 A | | 3/1959 | Hughes | |
| 3,116,983 A | | 1/1964 | Chafee, Jr. | |
| 3,318,016 A | | 5/1967 | Chaffee, Jr. | |
| 4,019,259 A | | 4/1977 | Veraart | |
| 4,336,902 A | * | 6/1982 | Neal | 236/46 R |
| 4,418,271 A | | 11/1983 | Smock | |
| 4,642,907 A | * | 2/1987 | Best | 34/48 |
| 4,842,192 A | | 6/1989 | Range et al. | |
| 4,907,737 A | * | 3/1990 | Williams, Jr. | 236/11 |
| 5,416,400 A | * | 5/1995 | St. Louis | 318/781 |
| 5,443,541 A | | 8/1995 | St. Louis | |
| 5,673,497 A | | 10/1997 | St. Louis | |
| 6,064,043 A | | 5/2000 | Livers, Jr. et al. | |
| 6,079,121 A | | 6/2000 | Khadkikar et al. | |

* cited by examiner

*Primary Examiner*—Mark Paschall

(57) ABSTRACT

A control circuit for a clothes dryer operating with a 120 volt power supply compensates for changes in the ambient temperature to compensate for premature advancement of the dryer timer motor during an automatic drying cycle. The control circuit has a thermally biased low outlet thermostat and a thermally biased high outlet thermostat which control the energization of a heater in the dryer. The low outlet thermostat and the high outlet thermostat each open circuit at respective lower and higher predetermined temperatures when the outlet air flow from the dryer drum reaches the lower or higher respective predetermined temperatures to thereby de-energize the heater and advance the timer motor. The control circuit includes a thermally biased ambient thermostat that is normally open and unbiased, and that switches control of the heater energization from the low output thermostat to the high outlet thermostat when thermally biased and when the ambient temperature rises above a predetermined ambient temperature. The ambient thermostat becomes thermally biased when the low output thermostat is open circuited. Both the low and high output thermostats are normally thermally biased during the automatic drying cycle and are un-biased during user time selected drying cycles so that the low and high temperature thermostats cycle on and off at higher temperatures than they would during the automatic drying cycle.

7 Claims, 2 Drawing Sheets

DRYER CONTROL CIRCUIT

FIELD OF THE INVENTION

The present invention relates to an automatic clothes dryer and in particular to an electric control circuit for use during an automatic clothes drying cycle which provides ambient temperature compensation.

BACKGROUND OF THE INVENTION

Clothes dryers are known to employ an operating thermostat responsive to the exhaust air temperature from the dryer to cycle the dryer heater on and off during the drying cycle to maintain the temperature in the dryer within a set range. Small heating elements may be placed adjacent the thermostat to provide a thermal bias. The provision of a thermal bias causes the thermostat to operate at a lower exhaust air temperature and is commonly used to lower the maximum exhaust air temperature at which the operating thermostat reacts.

While the use of thermally biased thermostats is known in the art, these thermostats have been used in automatic dryer applications where 240 volts is applied across the thermostats and dryer heater coils to deliver energy to heat the clothes to temperatures well above ambient. However, in small and mid-size clothes dryer applications where lower voltages of 110 to 120 volts and currents of 15 amps are employed, an automatic dryer operation has not been an energy efficient feature because the thermostats typically cause the dryer heating elements to automatically cycle on and off at too low of an outlet temperature. As a result, the dryers either have to apply heat to the clothing for periods longer than necessary or terminate the drying cycle when the clothes are still wet. This inefficient automatic drying operation problem is further enhanced when the ambient temperature around the dryer is relatively high resulting in a small temperature difference between the ambient temperature and the temperature at which the outlet dryer cycles on and off. As a result, automatic drying cycles have not been offered for all small and mid-sized dryers operating with 120 volt power sources. Instead, these dryers are provided with a time selected drying operation where the dryer operates at about 140° F. for the time specified by the user before entering a cool down period.

Accordingly, there is a need for an energy efficient, ambient responsive, automatic dryer control circuitry suitable for use with small and mid-sized clothes dryers capable of operating with 120 volt power supply.

SUMMARY OF THE INVENTION

The present invention relates to a clothes dryer operating with a 120 volt power supply and having an automatic control circuit that compensates for changes in the ambient temperature to compensate for premature advancement of the dryer timer motor during an automatic drying cycle. The control circuit comprises a low outlet thermostat and a high outlet thermostat which control the energization of a heater in the dryer. The low outlet thermostat and the high outlet thermostat each open circuit at respective lower and higher predetermined temperatures when the outlet air flow from the dryer drum respectively reaches the lower or higher predetermined temperatures to thereby de-energize the heater and advance the timer motor. The control circuit includes an ambient thermostat that switches control of the heater energization and timer motor advancement from the low output thermostat to the high outlet thermostat when the ambient temperature rises above a predetermined ambient temperature. The control circuit provides for more energy efficient drying in an automatic drying cycle for small and mid-size dryers operating with a 120 volt power source.

The ambient thermostat preferably has an internal biasing heater or resistor that is energized to permit the ambient thermostat to switch between the low output thermostat and the high output thermostat when the predetermined ambient temperature is reached. Preferably, the internal biasing heater of the ambient thermostat is energized when the low output thermostat is open circuited.

In accordance with a further preferred aspect of the present invention, both the low and high output thermostats each have internal biasing heaters that are normally energized during the automatic drying cycle and are de-energized during time selected drying cycles so that the low and high temperature thermostats cycle on and off at higher temperatures than they would during the automatic drying cycle.

In accordance with an aspect of the present invention there is provided a control circuit for controlling the operation of a clothes dryer having a dryer drum, a drum air inlet and a drum air outlet permitting an air stream to flow into and out of the dryer drum, a heater for heating the air stream before the air stream passes into the dryer drum, and a control circuit for controlling energization of the heater during an automatic drying cycle.

The control circuit comprises:

a supply line and a neutral line adapted for connection to a 120 volt power supply source;

a series connection across the supply line and the neutral line of a low output temperature thermostat, a high output temperature thermostat and the heater, the low output temperature thermostat opening at a first predetermined temperature and the high output temperature thermostat opening at a second predetermined temperature higher than the first predetermined temperature thereby controlling energization of the heater;

a timer motor connected between the supply line and a first point located between the high output temperature thermostat and the heater, the timer motor advancing to end the automatic drying cycle during periods when either one of the low output temperature thermostat and high output temperature thermostat is open;

an ambient thermostat for sensing ambient temperature and being electrically connected in parallel with the low outlet thermostat and in series with the supply line and a second point between the low output temperature thermostat and the high output temperature thermostat, the ambient thermostat providing a bypass circuit around the low temperature thermostat when a predetermined ambient temperature is reached; and, wherein, the low output temperature thermostat opens when the temperature of the air stream exiting out of the drum reaches the first predetermined temperature to control cycling on and off of the heater and to control the advancement of the timer motor, and wherein control cycling on and off of the heater and control of advancement of the timer motor in response to the high output temperature thermostat opening at the second predetermined temperature occurs when the first outlet thermostat is bypassed out of circuit by the ambient thermostat.

BRIEF DESCRIPTION OF THE DRAWINGS

For a better understanding of the nature and objects of the present invention reference may be had to the following detailed description when taken in conjunction with the accompanying electrical diagrammatic drawings wherein.

DETAILED DESCRIPTION OF EMBODIMENTS

Figure 1:
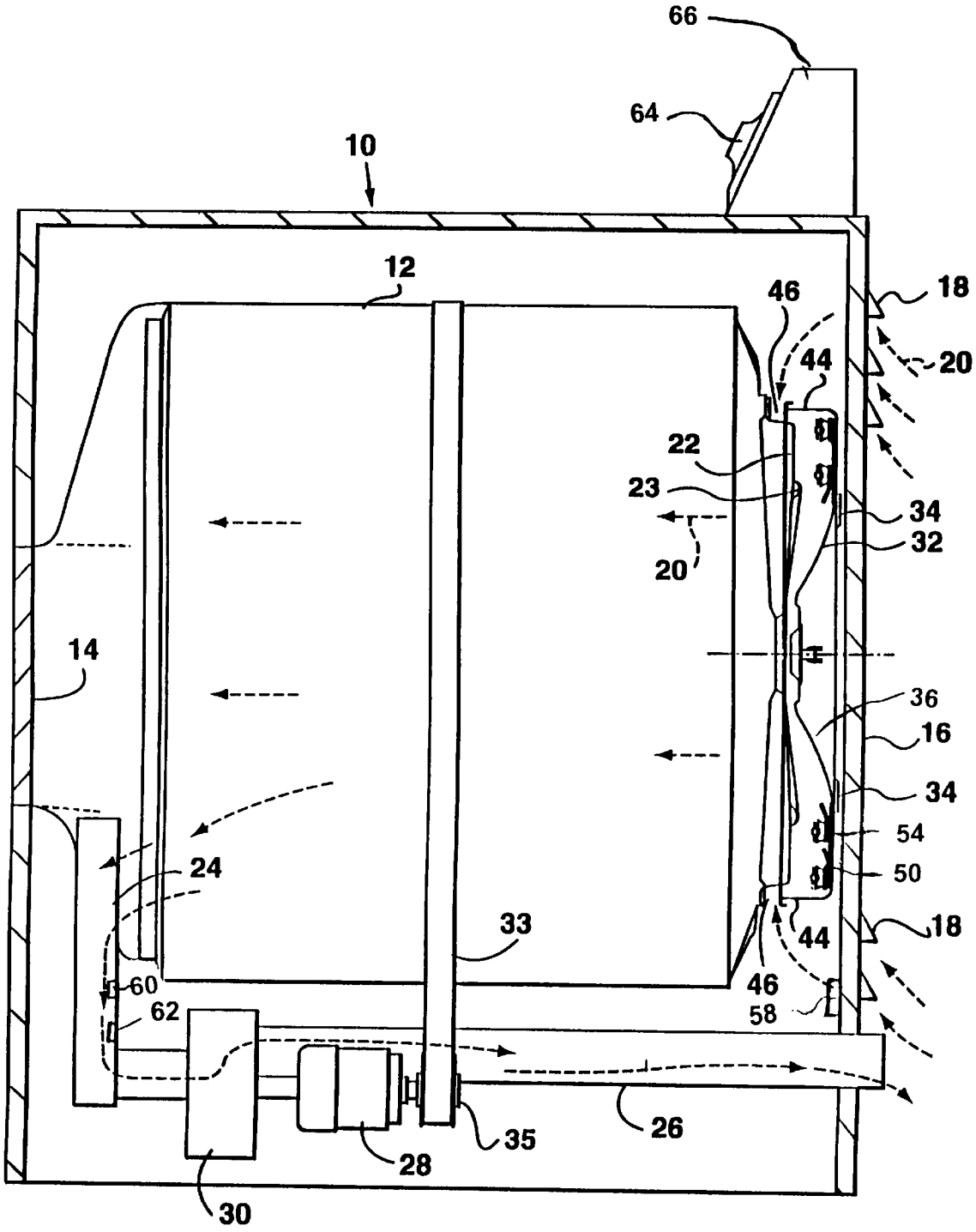
FIG. 1 is a side view of a clothes dryer having the control circuit of the present invention; and, FIG. 2 is a schematic wiring diagram showing circuitry for the control circuitry of the present invention.

Referring to FIG. 1 there is shown a clothes dryer 10 having a rotating drum 12 mounted therein. The rotating drum 12 has an open front through which access can be gained through door 14 of the dryer 10 for the insertion and removal of clothing and other articles from the drum 12.

The clothes dryer 10 has a rear panel 16 provided with a series or plurality of louvers 18 through which air may be drawn into the interior of the dryer 10. The airflow is shown by arrows 20 passing through the louvers, through a series of openings 23 in the rear end head 22 of the dryer drum 12 through front ducting 24 and out through exhaust ducting 26 that defines an exhaust air stream path. Motor 28 rotates blower 30 to draw the air 20 through the drum 12. The motor 28 through pulley 35 and belt 33 also causes the rotation of the dryer drum 12.

A heater housing assembly 32 is mounted by suitable bolts 34 to the rear panel 16 of the dryer 10. The heater assembly 32 is adjacent the end head 22 of the drum 12. The heater assembly 32 has a rear wall 36 that is spaced from the rear end head 22. The heater assembly has an electrical heating element 50 mounted on insulators 54. It should be understood that an alternative construction for the dryer drum 12 and heater assembly 32 may comprise a stationary rear end head with a heater box mounted to the rear end head for supplying heated air into the dryer drum. Further, the drum shows an axial air flow therethrough and alternatively the air flow may return through an outlet exhaust in the rear wall of the dryer drum.

An ambient temperature thermostat 58 is shown mounted below the heater assembly 32 of the electric dryer. This thermostat 58 is designed to open when the ambient temperature of the air flow into the dryer drum exceeds about 25° C. Second and third temperature thermostats 60, 62 are mounted in the dryer outlet air duct to respond to a rise in the temperature of the air exiting the clothes dryer drum 12.

On top of the dryer 10 is a control panel 66 which includes control dials 64, or touch sensitive key pads, for controlling the operation of the dryer 10. It should be understood that these dials are utilized to provide for automatic control of the dryer 10 through a warm up cycle, one or more drying cycles and a cool down cycle. These dials can also select timed drying cycles.

Figure 2:
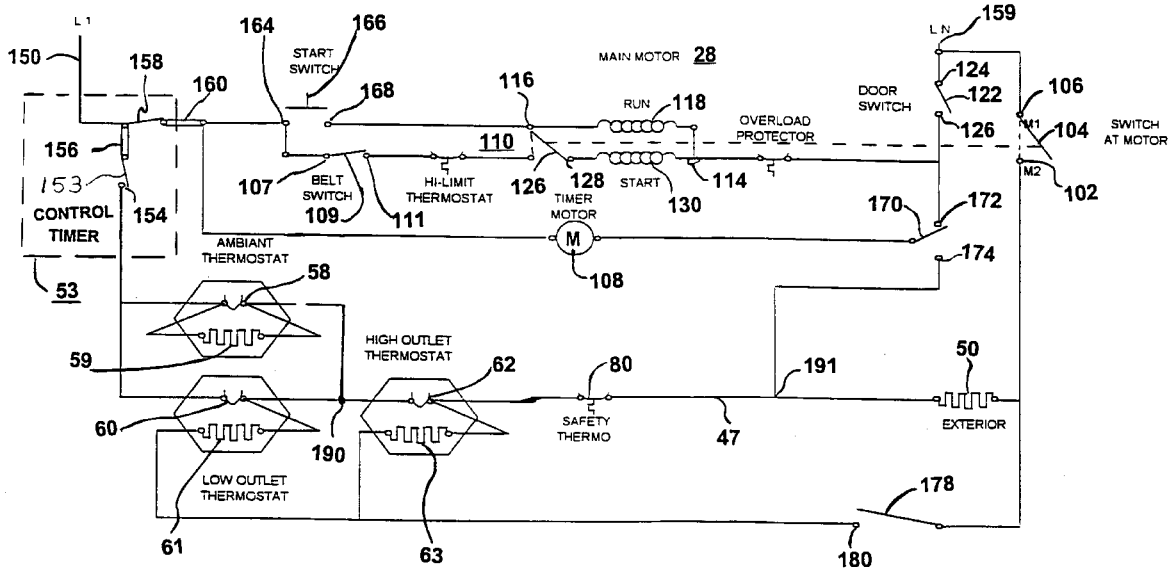

Referring to FIG. 2 the control circuit of the present invention in relation to an electric dryer is shown. A 120 volt power source is fed to terminal 150 designated as $L_1$ The neutral terminal is shown at 159. Terminal 150 is connected to one pole 156 of timer motor control switches 153 and 158. The terminal 154 of switch 153 is connected to ambient thermostat 58 and a low output thermostat 60. Terminal 160 of timer control switch 158 is connected to timer motor 108 and to terminal 164 of motor start switch 166. Low output thermostat 60 is connected in series with high output thermostat 62 which in turn is connected in series with heater 50. These three devices, 60, 62 and 50 are found in series branch 47 connected between the supply line 150 and neutral line 159. Also connected in the series branch between resistance heater 50 and thermostat 62 is safety thermostat 80. Safety thermostat is set to open should the dryer drum air inlet temperature exceeds the maximum preset inlet air temperature.

Pole 168 of start switch 166 is connected to pole 116 of centrifugal switch 110 which in turn is connected to "run" winding 118 of the blower and drum drive motor 28. The other end of run winding 118 is connected to terminal 114 which is connected to terminal 126 of door switch 122. The other terminal 124 of switch 122 is connected to neutral terminal 159.

Pole 164 of start switch 166 is also connected to pole 126 via poles 107 and 111 of belt break switch 109. The blade 126 of centrifugal switch 110 is shown in its "start" position, i.e. bridging poles 116 and 128. Pole 128 is connected to "start" winding 130 of motor 28. The other end of start winding 130 is connected to terminal 114.

The timer motor 108 is connected to switch 170 which toggles between poles 172 and 174. Switch 170 is ganged with switch 178 at the bottom of the circuit drawing and the functioning of these switches for a timed drying cycle selection is discussed hereinbelow. However, in the positions shown for switches 170 and 178, the control circuit is in the timed drying cycle selection where the dryer operates for a predetermined amount of time during which the heater 50 is cycled on and off controlled by either of outlet thermostats 60 or 62 and timer motor 108 continuously advances. When the switch 170 is connected to pole 174, switch 178 is also closed and connected to pole 180. In this arrangement, the timer motor 108 is in an automatic dry cycle and is connected to series branch 47 at point 191. The timer motor 108 does not advance as long as the heater coil 50 remains energized from $L_1$.

As the clothes begin to dry, the temperature of the air exiting the drum begins to increase and outlet thermostats 60 and 62 together with the ambient thermostat 58 control energization of heater coil 50. In the control circuit, the ambient thermostat 58 is connected from pole 154 between the outlet thermostats 60 and 62 at point 190. The ambient thermostat 58 has an internal biasing heater (resistor) 59 connected across pole 154 and point 190 between outlet thermostats 60 and 62. The outlet thermostats 60 and 62 each have respective internal biasing heaters 61, 63. Internal biasing heater 61 is connected from a point 190 between the low output thermostat 60 and the high outlet thermostat 62 to the neutral terminal 159 through switch 178. Internal biasing heater 63 is connected between point 191 in the series branch 47 to the neutral terminal 159 through switch 178.

During the automatic dry setting, the level of energization (i.e. current flow along series branch 47 and through) heater coil 50 is controlled by the closed or open states of thermostats 58, 60 and 62. The following describes the functioning of the present invention as it relates to an "automatic" cycle for the 120 volt dryer.

The preferred aspect of the present invention is in the use of a biasable low drum outlet control thermostat 60 to provide the automatic cycling required for the automatic cycle at low ambient temperature below 25° C. and, a biasable, normally open, ambient air thermostat 58, to switch from the biasable low drum outlet control thermostat 60 to a biasable regular drum outlet thermostat 62, when the ambient temperature around the dryer is above 25° C. Both the outlet thermostats 60, 62 are positioned to sense the temperature of the air exiting the dryer drum 12. The ambient air thermostat 58 is positioned to sense the temperature of the air entering the dryer cabinet 10.

When the dryer is operated on an automatic cycle in an ambient temperature of 15 to 25° C., the low outlet thermostat 60 and the high outlet thermostat 62 are closed at the beginning of the cycle. The timer contact or switch 170 is open to pole 172 and is closed to pole 174. Also switch 178 is closed to pole 180. As a result, the internal biasing heaters 61 and 63 of both the low outlet temperature thermostat 60 and the high outlet temperature thermostat 62 are energized. The ambient thermostat 58 is open and its internal biasing heater 59 is not energized since the low outlet temperature thermostat 60 is closed and same voltage is applied to both sides of the biasing heater 59.

As the drying cycle advances, the clothes humidity goes down and the temperature of the air exiting the drum 12 goes up. At a certain predetermined temperature, established as the proper calibration of its sensing disc and the proper wattage level of internal biasing heater 61, the low outlet temperature thermostat 60 opens. When thermostat 60 opens, the dryer heating element 50 and the internal biasing heaters 61 and 63 of both the low outlet temperature thermostat 60 and high outlet temperature thermostat 62 are de-energized. Also, the internal biasing heater of the ambient thermostat 58 is energized.

The calibration of the ambient thermostat 58 and its internal biasing heater 59 are calibrated so that, when the ambient temperature is below 25° C., the thermostat 58 remains open. After a period of time, since the dryer heating element 50 is off, the temperature of the air exiting the drum will go down and the low outlet temperature thermostat 60, with its own internal biasing heater 61 de-energized, closes. The dryer heating element 50 and the internal biasing heaters 61 and 63 of the low outlet temperature thermostat 60 and the high outlet temperature thermostat 62 become re-energized.

When the low outlet temperature thermostat 60 is open and the timer switch 170 is closed to pole 174, the timer motor 108 advances extra space. When the low outlet temperature thermostat 60 closes the timer motor 108 stops. This cycling open and closed of the low outlet temperature thermostat 60 and the corresponding timer 108 continues until the timer 108 advances to the cool down cycle and then to the "off" position. With the proper calibration of the thermostats 58, 60, and 62, the timer 108 advances to the "off" position when the clothes load reach the proper degree of dryness.

With the same "automatic" cycle selection, if the ambient temperature is above 25° C., the opening of the low outlet temperature thermostat 60 would occur sooner and thermostat 60 stays open longer before closing again. To prevent the timer motor 108 from advancing to the "off" position too soon and the dryer stopping when the clothes are still too damp, the present invention further comprises a high outlet temperature thermostat 62 that operates in co-operation with the ambient thermostat 58. Thus, when the ambient temperature is above 25° C., the automatic drying cycle runs initially as described above, however, when the low outlet temperature thermostat 60 opens, the internal biasing heater 59 of the ambient thermostat 58 becomes energized and after a short while, the ambient thermostat 58 closes before thermostat 60 cycles closed. When the ambient thermostat 58 closes, the dryer heating element 50 and the internal biasing heaters 61 and 62 of both the low outlet temperature thermostat 60 and the high outlet temperature thermostat 62 are energized. This prevents closing of the low outlet thermostat 60. The dryer heater 50 continues to heat the air entering the dryer drum 12 until the temperature of the air exiting the drum 12 reaches a second higher predetermined temperature that causes the biased high outlet temperature thermostat 62 to open. Once the thermostat 62 opens, the cycling of the heating element 50 and timer motor 108 advancement continues with opening and closing of the thermostat 62 until the end of the drying cycle is reached. The control circuit now cycles at a higher temperature associated with the higher temperature at which thermostat 62 opens, when biased, compared to the lower temperature at which thermostat 60 opens, when biased. With the circuit cycling at a higher temperature, the clothes are properly dried even though the dryer 10 is operating in higher ambient air temperature.

It should be understood that when the "automatic" cycle is selected, the dryer automatically stops when the clothes load is dried but, to get the automatic cycle termination, the thermostats 60 and 62 must cycle on-off to get the timer motor 108 to advance. With the 120 volt dryer, the energy input is relatively low and the low outlet temperature thermostat 60 and the high outlet temperature thermostat 62 are set to cycle at relatively low temperatures. If it was not for the automatic termination requirement, there would be no need to cycle the heater on-off at these low temperatures. Therefore, to further improve the drying performance, the present invention further provides another preferred feature that automatically prevents this low temperature cycling of the thermostats 60 and 62 when the "timed" cycle is selected. That is when a user sets the drying time for the dryer to operate. In the "timed" selection, the timer controlled contact or switch 178 is open from pole 180 and, as a result, no current flows through internal biasing heaters 61 and 63. Accordingly, the low outlet temperature thermostat 60 and the high outlet temperature thermostat 62 are no longer biased and the exhaust air temperature from the dryer drum 12 has to reach a higher temperature before the low outlet temperature thermostat 60 and the high outlet temperature thermostat 62 start cycling.

What is claimed is:

1. A control circuit for controlling the operation of a clothes dryer having a dryer drum, a drum air inlet and a drum air outlet permitting an air stream to flow into and out of the dryer drum, a heater for heating the air stream before the air stream passes into the dryer drum, and a control circuit for controlling energization of the heater during an automatic drying cycle, the control circuit comprising:

a supply line and a neutral line adapted for connection to a 120 volt power supply source;

a series connection across the supply line and neutral line of a low output temperature thermostat, a high output temperature thermostat and the heater, the low output temperature thermostat opening at a first predetermined temperature and the high output temperature thermostat opening at a second predetermined temperature higher than the first predetermined temperature thereby controlling energization of the heater;

a timer motor connected between the supply line and a first point located between the high output temperature thermostat and the heater, the timer motor advancing to end the automatic drying cycle during periods when either one of the low output temperature thermostat and high output temperature thermostat is open;

an ambient thermostat for sensing ambient temperature and being electrically connected in parallel with the low output thermostat and in series with the supply line and a second point between the low output temperature thermostat and the high output temperature thermostat, the ambient thermostat providing a bypass circuit around the low temperature thermostat when a predetermined ambient temperature is reached; and, wherein, the low output temperature thermostat opens when the temperature of the air stream exiting the drum reaches the first predetermined temperature to control cycling on and off of the heater and to control the advancement of the timer motor, and wherein control cycling on and off of the heater and control of advancement of the timer motor in response to the high output temperature thermostat opening at the second predetermined temperature occurs when the first outlet thermostat is bypassed by the ambient thermostat.

2. The clothes dryer of claim 1 wherein the ambient thermostat is normally open and is thermally biased by a first electrical biasing heater connected across the ambient thermostat which when energized permits the ambient thermostat to close at said predetermined ambient temperature, and the opening of the low output temperature thermostat further energizing the first electrical biasing heater to permit closing of the ambient thermostat when the predetermined ambient temperature is reached and thereby bypass the low output temperature thermostat.

3. The clothes dryer of claim 2 wherein the low output temperature thermostat has a second biasing heater connected from the series branch at the second point between the low output temperature thermostat and high output temperature thermostat to the neutral line to be energized during the automatic drying cycle, and the high output temperature thermostat having a third biasing heater connected from the series branch at the first point between the high output temperature thermostat and the heater to the neutral line to be energized during the automatic drying cycle.

4. The clothes dryer of claim 3 further including first and second switches responsive to a user selecting a timed drying cycle for respectively switching the timer motor from a first connection to the first point to a second connection to neutral line to permit continuous advancement of the timer motor and for opening a third connection between the second and third biasing heaters to the neutral line so as to raise the temperatures at which the low output temperature thermostat and high output temperature thermostat open to respectively higher third and fourth predetermined temperatures.

5. A clothes dryer adapted to be connected to a 120 volt power supply source and having a dryer drum, a drum air inlet and a drum air outlet permitting an air stream to flow into and out of the dryer drum, a heater for heating the air stream before the air stream passes into the dryer drum, and a control circuit for controlling the dryer though an automatic drying cycle, the control circuit comprising:

a supply line and a neutral line adapted for connection to the 120 volt power supply source;

a series branch connecting in series a low output temperature thermostat, a high output temperature thermostat and the heater across the supply line and the neutral line to control energization of the heater, the low output temperature thermostat and high output temperature thermostat being mounted in the dryer to sense the temperature of the air stream passing out of the drum, and the low output temperature thermostat opening at a first predetermined temperature that is less than a second predetermined temperature at which the high output temperature thermostat opens;

a timer motor connected between the supply line and the series branch at a first point of the series branch located between the high output temperature thermostat and the heater, the timer motor advancing to end the automatic drying cycle during period when either one of the low output temperature thermostat and high output temperature thermostat is open;

a thermally biased ambient thermostat mounted in the dryer for sensing ambient temperature, normally being in an open position, being electrically connected in parallel with the low output thermostat and in series with the supply line and a second point between the low output temperature thermostat and the high output temperature thermostat, the thermally biased ambient thermostat having a first electrical biasing heater connected across the thermostat which heater when energized permits the ambient thermostat to close when a predetermined ambient temperature is reached; and wherein, the low output temperature thermostat opens when the temperature of the air stream passing out of the drum reaches the first predetermined temperature to control cycling on and off of the heater and to control the advancement of the timer motor, and the opening of the low output temperature thermostat further energizing the first electrical biasing heater to permit the closing of the ambient thermostat when the predetermined ambient temperature is reached to bypass the low output temperature thermostat in the series branch, to control cycling on and off of the heater and to control the advancement of the timer motor in response to the high output temperature thermostat opening at the second predetermined temperature.

6. The clothes dryer of claim 5 wherein the low output temperature thermostat has a second biasing heater connected from the series branch at the second point between the low output temperature thermostat and high output temperature thermostat to the neutral line to be energized during the automatic drying cycle, and the high output temperature thermostat having a third biasing heater connected from the series branch at the first point between the high output temperature thermostat and the heater to the neutral, line to be energized during the automatic drying cycle.

7. The clothes dryer of claim 6 further including first and second switches responsive to a user selecting a timed drying cycle for respectively switching the timer motor from a first connection to the first point to a second connection to neutral line to permit continuous advancement of the timer motor and for opening a third connection between the second and third biasing heaters to the neutral line so as to raise the temperatures at which the low output temperature thermostat and high output temperature thermostat open to respectively higher third and fourth predetermined temperatures.

* * * * *